US005114351A

United States Patent [19]

Hoffmann

[11] Patent Number: 5,114,351

[45] Date of Patent: May 19, 1992

[54] SLIDING CONTACT ARRANGEMENT FOR CARBON BRUSHES

[75] Inventor: Peter Hoffmann, Steeg, Austria

[73] Assignee: Hoffmann & Co. Elektrokohle KG, Steeg, Austria

[21] Appl. No.: 466,397

[22] PCT Filed: Oct. 27, 1988

[86] PCT No.: PCT/EP88/00970

§ 371 Date: Apr. 27, 1990

§ 102(e) Date: Apr. 27, 1990

[87] PCT Pub. No.: WO89/04073

PCT Pub. Date: May 5, 1989

[30] Foreign Application Priority Data

Oct. 27, 1987 [DE] Fed. Rep. of Germany ..... 3736535

[51] Int. Cl.[5] ..... H01R 39/00

[52] U.S. Cl. ..... 439/13; 310/239; 310/242; 310/245

[58] Field of Search ..... 310/238, 239, 240, 242, 310/245, 247, 248, 249; 439/13, 14, 16, 18, 19, 22, 23, 24, 25, 26, 27, 28, 700, 824

[56] References Cited

U.S. PATENT DOCUMENTS

| | | | |
|---|---|---|---|
| 3,028,515 | 3/1962 | Cheetham | 310/247 |
| 3,171,050 | 2/1965 | Gordon | 310/239 |
| 4,266,155 | 5/1981 | Niemela | 310/239 |

FOREIGN PATENT DOCUMENTS

| | | | |
|---|---|---|---|
| 0881831 | 6/1953 | Fed. Rep. of Germany . | |
| 3204865 | 8/1983 | Fed. Rep. of Germany | 310/239 |

OTHER PUBLICATIONS

"Shunts for High-Current Density Brushes"; pp. 89-94; P. Reichner et al.; I.E.E.E., vol. CHMT. 2, No. 1 (Mar. 1979).

*Primary Examiner*—R. Skudy

*Attorney, Agent, or Firm*—Townsend and Townsend

[57] ABSTRACT

A spring carbon brush which can be slid into a holder is blocked in the corresponding feed position on the holder when acted on by forces opposed to the direction of feed by a catch or expansion device in such a way that it can only move in the direction opposed to the direction of feed by overcoming an additional, preferably gradual, elastic force.

3 Claims, 1 Drawing Sheet

SLIDING CONTACT ARRANGEMENT FOR CARBON BRUSHES

BACKGROUND OF THE INVENTION

The invention relates to a sliding contact arrangement, in particular for carbon brushes, also referred to herein as sliding contact members.

Various embodiments of such a sliding contact arrangement are known from DE-C 881 831. In all these embodiments the restraining or blocking device is coupled to the pressure spring and is formed of expandable spring arms, balls, levers or the like which prevent an upward movement of the lower end of the pressure spring. The blocking device is intended to prevent momentary separations between the sliding contact member and a slide ring or the like due to jolts and vibrations, without the need for applying an excessive amount of spring force.

The known blocking devices are mechanically of a relatively complex construction. In addition, they are incapable of preventing the sliding contact member from slipping or tilting within the holder. This can compromise the correct positioning of the contact member against the slide ring or the like despite the functioning of the blocking device.

SUMMARY OF THE INVENTION

It is therefore an object of the present invention to improve as economically as possible the guiding of the contact member within the holder in a sliding contact arrangement of the above mentioned kind.

The object of the invention is achieved by providing resilient bristles between the brush and the holder which guide the brush in the forward direction towards the commutator ring and which block movement of the brush in the opposite direction.

The restraining or blocking device of the present invention functions in a two-fold manner. First, it generates a lateral guiding force in the feed direction, and second, it generates a restraining force opposite to the feed direction. The flexible bristles, instead of rigidly blocking the sliding contact member, permit small displacements against the force generated by the bristles and without thereby affecting the force generated by the compression spring during normal operation.

IEEE Transactions. Vol. CHMT-2, No. 1, Mar. 1983 discloses a contact member adapted for slidable movement within a holder, and a current collector contact engaging a side surface of the sliding contact member and which has many resilient, obliquely oriented contacts. Thus the electrical current flows through many contact points to the side surface of the sliding contact member. The resilient contacts guide the sliding contact member with relatively little friction in the feed direction. However, a lateral expansion of the contacts and a resulting blocking against movement opposite to the feed direction does not take place.

BRIEF DESCRIPTION OF THE DRAWINGS

Embodiments of the present invention are discussed in greater detail with reference to the drawings below, in which.

DESCRIPTION OF THE PREFERRED EMBODIMENTS

Figure 1:
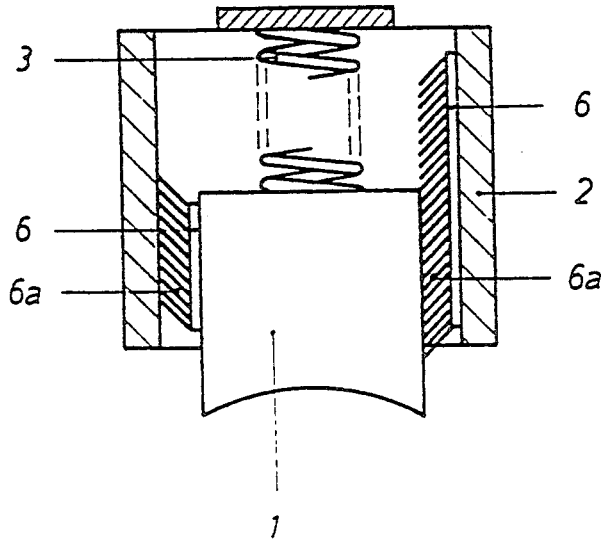
FIGS. 1 and 2, respectively, are cross-sectional views of a sliding contact arrangement of the present invention.

The embodiment of FIG. 1 shows a carbon brush mounted for slidable movement inside a holder 2 to which the force generated by coil spring 3 is applied. Situated in the gap between the lateral sides of carbon brush or sliding contact 1 and the opposed inner surfaces of holder 2 are bristle strips 6 constructed of short, stiff bristles which are oriented obliquely upward relative to holder 2. Strip 6 is mounted on one side of the carbon brush as seen on the left side of FIG. 1 with its resilient, stiff and parallel bristles 6*a* angled obliquely upward. In an alternative arrangement as seen on the right side of FIG. 1, strip 6 is affixed to the inner surface of holder 2 with its bristles oriented obliquely downward in the direction of carbon brush 1. The length and stiffness of bristles 6*a* are selected to permit a downward movement of the carbon brush in a feed direction under the force of spring 3, but, if there is any upward movement of the brush, the ends of the bristles (not identified in the drawing) flex outwardly between carbon brush 1 and holder 2 and thereby block the carbon brush from moving. The inherent flexibility of bristles 6*a* may permit some small movements of carbon brush 1 inside holder 2, but here the applied additional, e.g. progressively increasing, force exerted by bristles 6*a* is significantly larger than the force generated by pressure spring 3. Bristle strips 6 and their bristles 6*a* may be constructed of any suitable material, and in particular, of a sufficiently rigid plastic or of steel.

Figure 2:
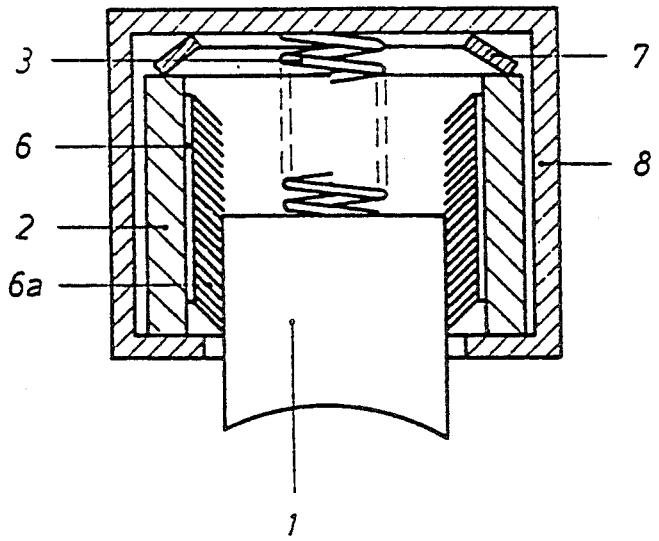

The arrangement of FIG. 2 corresponds in large part to that of FIG. 1, except that holder 2 is mounted for slidable movement inside a stationary guide 8 and can minimally move upwardly against the force generated by an additional, e.g. beveled disk spring 7. Strips 6 with bristles 6*a* are affixed to the inner wall of holder 2. They extend obliquely downward in the direction of carbon brush 1 and define a locking device. In this arrangement bristles 6*a* can be constructed so that they prevent substantially any movement of brush 1, since disk spring 7 permits such movements by the holder.

Both embodiments have in common that the carbon brush 1, in the case of upward movement, locks itself in place in such a way that upward movement is possible only by overcoming the additional force generated by bristles 6*a* in FIG. 1 or disk spring 7 in FIG. 2. By appropriately selecting the magnitude and progressive increase of this additional force, totally independently of the selection of pressure spring 3, upward movements of carbon brush 1 are effectively eliminated. Moreover, the bristle strips improve the guidance of the contact member in the holder and the spring action of the strips reduces play or looseness between them.

The self-locking arrangement of the present invention can also function as a contact for flowing electrical current to carbon brush 1 when strips 6 and bristles 6*a* are constructed of a metallic or in any event an electrically conductive material.

I claim:

1. A sliding contact arrangement comprising a holder having spaced apart, opposed internal surfaces, a sliding contact member movably guided in said holder, disposed between and having sides which oppose and are spaced apart from said internal surfaces, spring means biasing said sliding contact member in a feed direction, and blocking means for preventing movement of said sliding contact member relative to said holder in a direction opposite to said feed direction and permitting movement of said sliding contact member under a biasing force exerted by the spring means in said feed direction, said blocking means including bristle strips disposed between said sides and said internal surfaces which oppose each other, each bristle strip including a multiplicity of resiliently stiff, substantially parallel bristles which are obliquely inclined relative to said sides and said internal surfaces, said bristle strips being attached to one of the said opposing sides and said inner surfaces, ends of the bristles engaging another one of said sides and said inner surfaces, each of said bristles being oriented and having a length and a stiffness selected so that movement of said sliding contact member in the feed direction causes said bristle ends to move substantially freely relative to said another one of said sides and internal surfaces to thereby permit free movement of said sliding contact member in said feed direction, and so that said bristle ends blockingly engage said another one of said sides and said inner surfaces when said sliding contact member is urged in said opposite direction to thereby prevent movement of said sliding contact member in said opposite direction.

2. A sliding contact arrangement according to claim 4, characterized in that the bristle strips (6) with the bristles (6*a*) are constructed of a plastics material.

3. A sliding contact arrangement according to claim 4, characterized in that the bristles (6*a*) are constructed of steel.

* * * * *